US011459006B2

(12) United States Patent
McGavock, Jr. et al.

(10) Patent No.: US 11,459,006 B2
(45) Date of Patent: Oct. 4, 2022

(54) MODULAR LAMP SYSTEM FOR RAILROAD CROSSING WARNING DEVICE

(71) Applicant: Siemens Mobility, Inc., New York, NY (US)

(72) Inventors: Richard Alan McGavock, Jr., Columbia, MO (US); Brian Harp, New Albany, IN (US)

(73) Assignee: Siemens Mobility, Inc., New York, NY (US)

( * ) Notice: Subject to any disclaimer, the term of this patent is extended or adjusted under 35 U.S.C. 154(b) by 0 days.

(21) Appl. No.: 17/049,209

(22) PCT Filed: Jun. 14, 2018

(86) PCT No.: PCT/US2018/037518
§ 371 (c)(1),
(2) Date: Oct. 20, 2020

(87) PCT Pub. No.: WO2019/240795
PCT Pub. Date: Dec. 19, 2019

(65) Prior Publication Data

US 2021/0237785 A1 Aug. 5, 2021

(51) Int. Cl.
*B61L 5/18* (2006.01)
*B61L 29/04* (2006.01)
(Continued)

(52) U.S. Cl.
CPC ..... *B61L 5/1854* (2013.01); *B61L 29/04* (2013.01); *B61L 29/28* (2013.01); *F21V 19/04* (2013.01);
(Continued)

(58) Field of Classification Search
CPC .. H01R 33/94; H01R 33/945; H01R 33/9555; H01R 33/955; B61L 5/1854; B61L 29/28; F21V 19/04
See application file for complete search history.

(56) References Cited

U.S. PATENT DOCUMENTS 5,952,915 A 9/1999 Marquardt et al.
6,426,704 B1 * 7/2002 Hutchison ..... F21S 8/00 340/815.45
(Continued)

FOREIGN PATENT DOCUMENTS

EP 2320126 A1 5/2011
EP 3037713 A1 6/2016
WO 2017/039597 A1 3/2017

OTHER PUBLICATIONS

PCT International Search Report and Written Opinion of International Searching Authority dated Feb. 13, 2019 (Feb. 13, 2019) corresponding to PCT International Application No. PCT/US2018/037518 filed Jun. 14, 2018 (Jun. 14, 2018).

*Primary Examiner* — Rajarshi Chakraborty
*Assistant Examiner* — Michael Chiang

(57) ABSTRACT

A modular lamp system (200) for a railroad crossing warning device includes a crossing lamp (210) and a crossing lamp base (220) controllable by a wayside control device (40), and a module (230) comprising an electronic circuit (250), wherein the crossing lamp base (220) is configured to provide power to the crossing lamp (210) and the module (230), and wherein, when the crossing lamp (210), the crossing lamp base (220) and the module (230) are assembled and in operation, the crossing lamp (210) performs a first action and the module (230) performs a second action, which is different from the first action.

11 Claims, 2 Drawing Sheets

(51) Int. Cl.

| | |
|---|---|
| ***B61L 29/28*** | (2006.01) |
| ***F21V 19/04*** | (2006.01) |
| ***H01R 33/94*** | (2006.01) |
| *F21Y 115/10* | (2016.01) |
| *F21W 111/02* | (2006.01) |

(52) U.S. Cl.
CPC ..... *H01R 33/94* (2013.01); *F21W 2111/02* (2013.01); *F21Y 2115/10* (2016.08)

(56) References Cited

U.S. PATENT DOCUMENTS 7,554,457 B2 * 6/2009 Hounschell, II ..... B61L 5/1863 246/127
2001/0032908 A1 * 10/2001 Anderson ..... B61L 29/24 246/124
2004/0119587 A1 6/2004 Davenport et al.
2006/0017583 A1 * 1/2006 Davenport ..... G01J 1/42 340/641
2008/0296442 A1 * 12/2008 Ruggiero ..... B61L 29/30 246/473.1
2009/0194642 A1 * 8/2009 Honeck ..... B61L 29/30 246/114 R
2010/0117553 A1 * 5/2010 Lee ..... F21K 9/232 315/294
2013/0256466 A1 * 10/2013 Carlson ..... B61L 23/041 246/218
2015/0338077 A1 * 11/2015 Johnson ..... H05B 47/19 362/234
2016/0215933 A1 * 7/2016 Skelton ..... H02J 7/00
2016/0226207 A1 * 8/2016 Fullerton ..... H01R 13/6675
2016/0247370 A1 * 8/2016 Lamb ..... G08B 21/0469
2016/0255697 A1 * 9/2016 Bhide ..... F21K 9/232 315/161
2018/0202636 A1 * 7/2018 Fox ..... B61L 29/22
2019/0115706 A1 * 4/2019 Christiansen ..... F21V 23/06

* cited by examiner

MODULAR LAMP SYSTEM FOR RAILROAD CROSSING WARNING DEVICE

BACKGROUND

1. Field

Aspects of the present disclosure generally relate to a modular lamp system for railroad crossing warning devices.

2. Description of the Related Art

Warning systems have been developed to warn people and cars of an approaching train at a railroad grade crossing. Railroad grade crossings, sometimes referred to in the U.K. as level crossings, are locations at which railroad tracks intersect roads. A constant warning time device, also referred to as a grade crossing predictor (GCP) in the U.S. or a level crossing predictor in the U.K., is an electronic device that is connected to the rails of a railroad track and is configured to detect the presence of an approaching train and determine its speed and distance from a railroad grade crossing. The constant warning time device will use this information to generate constant warning time signal(s) for controlling crossing warning device(s). A crossing warning device is a device that warns of the approach of a train at a crossing, examples of which include crossing gate arms (e.g., the familiar red and white striped wooden or fibreglass arms often found at highway grade crossings to warn motorists of an approaching train), crossing lights (such as the red flashing lights often found at highway grade crossings in conjunction with the crossing gate arms discussed above), and/or crossing bells or other audio alarm devices.

Railroad crossing lights or lamps do not currently offer any smart features. They are simply flashed by a crossing controller, such as a GCP, as a warning device. Any features such as gate level, lamp alignment, bell audio or lamp out detection are performed by devices external to the lamps. Building these types of features directly into the lamps is too costly as the failure of either the electronics or the lamp would require complete replacement.

SUMMARY

Briefly described, aspects of the present disclosure relate to modular lamp systems for railroad crossing warning devices, specifically modular lamp systems. The term 'railroad crossing' is also known and herein referred to as 'railroad grade crossing', 'grade crossing' or simply 'crossing'.

A first aspect of the present disclosure provides a modular lamp system for a railroad crossing warning device, comprising a crossing lamp and a crossing lamp base controllable by a wayside control device, and at least one module comprising an electronic circuit, wherein the crossing lamp base is configured to provide power to the crossing lamp and the at least one module, and wherein, when the crossing lamp, the crossing lamp base and the at least one module are assembled and in operation, the crossing lamp performs a first action and the at least one module performs a second action, which is different from the first action.

A second aspect of the present disclosure provides railroad crossing warning device comprising a modular lamp system as described herein.

DETAILED DESCRIPTION

To facilitate an understanding of embodiments, principles, and features of the present invention, they are explained hereinafter with reference to implementation in illustrative embodiments. In particular, they are described in the context of being modular lamp systems for railroad crossing warning devices. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

Figure 1:
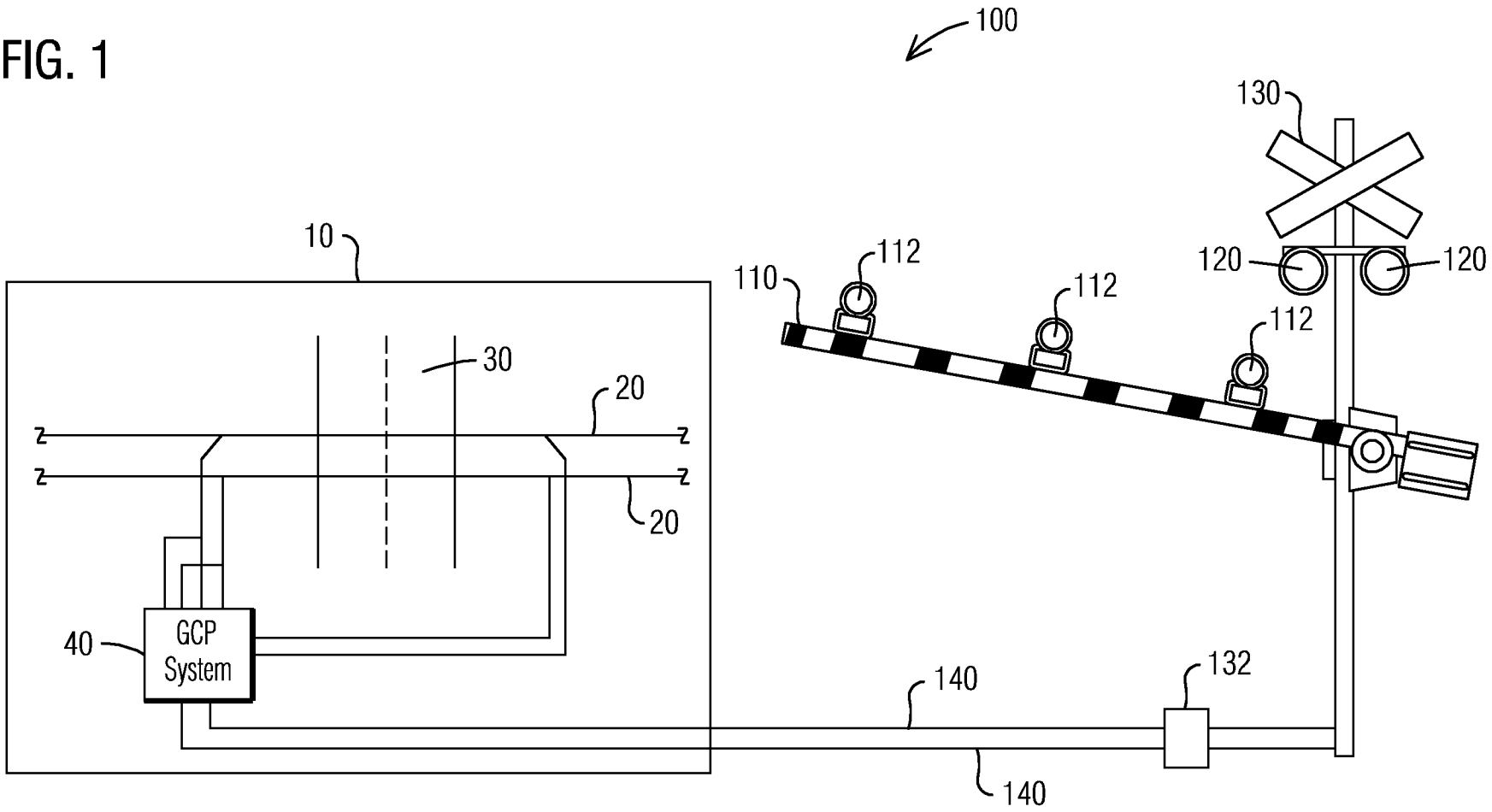
FIG. 1 illustrates a schematic of a railroad grade crossing in accordance with an exemplary embodiment of the present disclosure.

FIG. 1 illustrates a schematic of a railroad grade crossing 100 in accordance with an exemplary embodiment of the present disclosure. The railroad grossing crossing 100 is provided at a location in which a road 30 crosses a railroad track 20.

FIG. 1 illustrates multiple railroad crossing warning devices, also referred to as grade crossing warning devices, which warn of the approach of a train at the crossing of the road 30 and the railroad track 20, i.e., a railroad crossing. The railroad crossing warning devices include for example a crossing gate arm 110 with (or without) gate arm lights 112 spaced along the arm 110, crossing lamps (or lights) 120, a railroad crossbuck 130, and/or other devices not illustrated herein, as for example crossing bells or other audio alarm devices. The crossing warning devices are in communication with a grade crossing predictor (GCP) system 40 via connecting elements 140, which are for example electric cables. It should be noted that the components are illustrated schematically and are not drawn to scale, in particular are not drawn to scale in relation to each other.

The GCP system 40 is configured to detect the presence of an approaching train, determine its speed and distance from the railroad crossing, calculates when the train will arrive at the crossing, and will use this information to generate constant warning time signals for controlling the crossing warning devices 110, 112, 120, 130. Typically, a normally energized master relay 132, only shown schematically herein, is arranged between the GCP system 40 and the warning devices 110, 112, 120, 130, for example along the connecting elements 140 and operably coupled by the connecting elements 140, wherein an output of the GCP system 40 feeds a coil of the master relay 132. According to a pre-programmed time, for example a number of seconds and/or minutes, before projected arrival time of the approaching train, the GCP system 40 is configured such that the output feeding the coil of the master relay 132 is turned off to drop the master relay 132 and to activate the crossing warning devices 110, 212, 120, 130. It should be noted that the GCP system 40, the master relay 132 and the warning time devices 110, 112, 120, 130 will not be described in further detail as those of ordinary skill in the art are familiar with these devices and systems.

As noted before, currently known crossing lamps do not offer any smart features. They are simply flashed by a crossing controller, such as the GCP system 40, as a warning device. Currently, any features such as for example gate level, lamp alignment, bell audio or lamp out detection are performed by devices external to the lamps. Building these types of features directly into the lamps is too costly as the failure of either the electronics or the lamp would require complete replacement.

Figure 2:
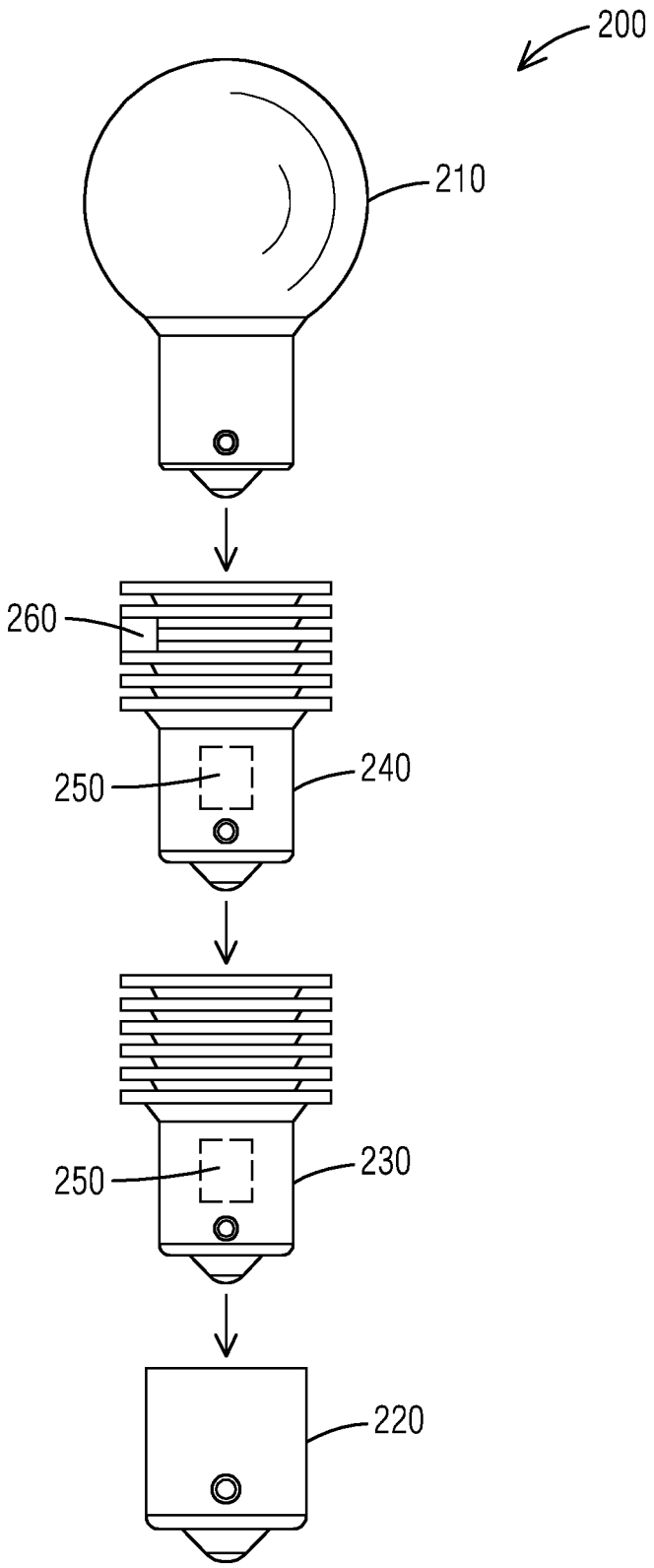
FIG. 2 illustrates a schematic of a modular lamp system in accordance with an exemplary embodiment of the present disclosure.

FIG. 2 illustrates a schematic of a modular lamp system 200 in accordance with an exemplary embodiment of the present disclosure. The modular lamp system 200 is for use in a railroad crossing warning system, specifically for a railroad crossing light 120 is illustrated for example in FIG. 1.

The modular lamp system 200 comprises a crossing lamp 210 and a crossing lamp base 220 controllable by a wayside control device, such as the GCP system 40 as shown in FIG. 1, and at least one module 230 comprising an electronic circuit 250. When the crossing lamp 210, the crossing lamp base 220 and the at least one module 230 are assembled and in operation, the crossing lamp 210 performs a first action and the at least one module 230 performs a second action, which is different from the first action. The at least one module 230 is configured to perform an action or electronic function for the crossing light 120 in addition to just providing light.

Essentially, the modular lamp system 200 serves as a platform for multiple functionalities. For example, the modular lamp system 200 is adapted to host a variety of electronic modules with different functions. The modular lamp system 200 provides "smart" railroad crossing lights 120 with "smart functions" other than simply providing light. The crossing lights 120 comprise or are built with the modular lamp system 200. The modular lamp system 200 may also be referred to as modular lamp digitization system.

The crossing lamp base 220 is configured to provide power to the crossing lamp 210 and the at least one module 230. The crossing lamp base 220 may provide power to the at least one module 230 directly and to the crossing lamp 210 indirectly, for example via the at least one module 230.

The crossing lamp 210 provides light when activated by the wayside control device, e.g., the GCP system 40 (which is the first action). The at least one module 230 performs a second action in addition to the first action that is performed by the crossing lamp 210. The second action can be performed simultaneously when the first action is performed or the first and second actions can be performed independently at different times. The second action comprises one or more electronic actions or functions other than providing light.

For example, the electronic circuit 250 of the at least one module 230 comprises an inclinometer for gate level detection for a crossing gate, such as the crossing gate arm 110 illustrated in FIG. 1. In another example, the electronic circuit 250 comprises an optical detector, such as a photocell, for light out detection of the crossing lamp 210. In another example, the electronic circuit 250 comprises a microphone for bell audio detection of a crossing bell located at the railroad crossing 100.

In another embodiment, the at least one module 230 is adapted to communicate with a remote device, specifically to communicate wirelessly with a remote device. Thus, the at least one module 230 comprises for example an air interface, e.g. Wi-Fi, to communicate wirelessly for example via Internet. The at least one module 230 may communicate data or information with respect to its functionalities. For example, when the module 230 comprises light out detection for the lamp 210 and has detected that the crossing lamp 210 is faulty (does not flash anymore), the module 230 then transmits this information to a remote system, for example a central train operator station or a rail operations center informing the responsible authorities that the lamp 210 is faulty and needs to be repaired or replaced.

In another embodiment, the at least one module 230 comprises a wired connection to a wayside control device, e.g., the GCP system 40. Thus, the at least one module 230 can be controlled by the GCP system 40, for example activated to perform one or more actions or functions. Further, the at least one module 230 can be adapted to transmit data to the GCP system 40, for example via the wired connection.

In another embodiment, the at least one module 230 comprises a connection point 260 for one or more external devices, wherein the one or more external devices are selected from a camera, a motion sensor, a temperature probe, an infrared (IR) receiver, a laser emitter, and a combination thereof.

In accordance with an exemplary embodiment of the present disclosure, the at least one module 230 is removable from the modular lamp system 200, wherein the crossing lamp 210 and lamp base 220 are still operable and working without the at least one module 230. When the at least one module 230 is malfunctioning or faulty, it can be replaced without having to replace the lamp 210 because of the modular configuration. The module 230 can be replaced with an identical module 230 (having the same functionalities) or with a different module having different functionalities.

In an embodiment, as shown for example in FIG. 2, the modular lamp system 200 comprises a plurality of modules 230, 240. FIG. 2 illustrates first and second modules 230, 240. However, the system 200 may comprise only one module 230 or may comprise three or more modules 230, 240. Each module 230, 240 comprises essentially the same shape and form so that they are interchangeable. Each module 230, 240 comprises one or more electronic circuits 250 to perform one or more electronic functions or actions.

In another embodiment, as also shown in FIG. 2, the crossing lamp 210 is an incandescent light bulb and the crossing lamp base 220 is a socket, wherein the one or more modules 230, 240 are nesting modules positioned between the crossing lamp 210 and the crossing lamp base 220. The nesting modules 230, 240 are stacked. Specifically, the lamp base 220 (socket) receives the first module 230, the first module 230 receives the second module 240, and the second module 240 receives the lamp 210. As can be seen in FIG. 2, the modules 230, 240 have substantially the same shape and form so that they are easily interchangeable. The crossing lamp base 220 provides power to the modules 230, 240 and to the crossing lamp 210. For example, the modules 230, 240 provide pass-through power to the crossing lamp 210.

The first module 230 can be configured for wireless or wired data communication and can comprise a dip switch interface for user configuration. The second module 240 can be configured to comprises electronic functions including an inclinometer for gate level detection, photocell for light out detection, microphone for bell audio detection. Further, the second module 240 can comprise connection point 260 for connecting external devices such as cameras, motion sensors, temperature sensors etc. As noted before, the modules 230, 240 are interchangeable. Further, each of the modules 230, 240 can comprise less, more or different functionalities than those described above. For example, a customer or user of the lamp system 200 may require only one module 230 with wireless communication capabilities, wherein another customer or user may require multiple functions such as wireless communication capabilities, gate level detection and light out detection. Those multiple functions may be incorporated into one module 230 or multiple modules 230, 240, depending on for example available space for placing modules or costs.

In another embodiment, the crossing lamp 210 comprises light emitting diode(s) (LED) and the crossing lamp base 220 is a LED circuit board, wherein the at least one module 230 is arranged on the LED circuit board. In this case, the one or more modules 230, 240 can be daughter boards stacked on the LED circuit board forming the base 220. When configured as LEDs and LED circuit board, the modules 230, 240 are also easily removable and/or replaceable due to a modular configuration. Given the 20-year lifespan of some LED lamp modules, this allows for swapping modules as technology advances without replacing the operational lamps.

The modules 230, 240 of the modular lamp system 200 increase safety at railroad crossings, provide additional event logging capabilities, allow the lamps to operate independently with minimal external input. The need for human analysis, for example manually inspecting crossing equipment, is eliminated due the functionalities of the modules 230, 240. Further, the modular lamp system 200 allows for development of new technologies and methodologies without the need for an entirely new product development cycle for each additional feature.

Existing crossing lights, such as the crossing lights 120 of FIG. 1, can be easily equipped (retrofitted) with the modular lamp system 200. For example, one or more modules 230, 240 embodied as nesting modules can be added to existing crossing lights 120.

It should be noted that the described modular lamp system 200 may not only be used for railroad crossing lights, but also for other light systems or signals such as for example traffic lights (for roads and railroads) or warning lights.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

The invention claimed is:

1. A railroad crossing warning device, comprising:

a modular lamp system comprising:

a crossing lamp and a crossing lamp base controllable by a wayside control device, and, a plurality of modules including a first module and a second module, wherein the plurality of modules is positioned between the crossing lamp and the crossing lamp base, wherein the crossing lamp base is configured to provide power to the crossing lamp and the plurality of modules, wherein the crossing lamp is configured to provide light when activated by the wayside control device, wherein the first module is configured for wireless communication with a remote device, wherein the second module comprises an inclinometer for gate level detection for a crossing gate, and wherein the second module comprises a connection point for connecting to one or more external devices, the one or more external devices are at least one of a camera, a motion sensor, a temperature probe, an infrared (IR) receiver, a laser emitter, and a combination thereof.

2. The railroad crossing warning device of claim 1, wherein the first module or the second module is replaceable without replacing the crossing lamp.

3. The railroad crossing warning device of claim 1, wherein the second module comprises an optical detector for light out detection of the crossing lamp.

4. The railroad crossing warning device of claim 1, wherein the second module comprises a microphone for bell audio detection of a crossing bell.

5. The railroad crossing warning device of claim 1, wherein the first module comprises a wired connection to the wayside control device.

6. The railroad crossing warning device of claim 5, wherein the wayside control device comprises a grade crossing predictor (GCP).

7. The railroad crossing warning device of claim 1, wherein the first module comprises a dip switch interface for user configuration.

8. The railroad crossing warning device of claim 1, wherein the plurality of modules are interchangeable.

9. The modular lamp system of claim 8, wherein the plurality of modules provide pass-through power to the crossing lamp.

10. The railroad crossing warning device of claim 1, wherein the crossing lamp is an incandescent light bulb and the crossing lamp base is a socket.

11. The modular lamp system of claim 1, wherein the crossing lamp comprises a light emitting diode (LED) and the crossing lamp base is a LED circuit board, wherein the plurality of modules are daughter boards stacked on the LED circuit board.

* * * * *